United States Patent [19]

Terauchi

[11] Patent Number: 4,594,061

[45] Date of Patent: Jun. 10, 1986

[54] SCROLL TYPE COMPRESSOR HAVING REINFORCED SPIRAL ELEMENTS

[75] Inventor: Kiyoshi Terauchi, Isesaki, Japan

[73] Assignee: Sanden Corporation, Gunma, Japan

[21] Appl. No.: 783,812

[22] Filed: Oct. 7, 1985

Related U.S. Application Data

[63] Continuation of Ser. No. 540,549, Oct. 11, 1983, abandoned.

[30] Foreign Application Priority Data

Oct. 9, 1982 [JP] Japan ..... 57-152746[U]

[51] Int. Cl.[4] ..... F01C 1/04; F01C 21/08

[52] U.S. Cl. ..... 418/55

[58] Field of Search ..... 418/55, 57, 59

[56] References Cited

U.S. PATENT DOCUMENTS 2,324,168 7/1943 Montelius ..... 418/55
3,600,114 8/1971 Dvorak et al. ..... 418/55
3,874,827 4/1975 Young ..... 418/55
4,396,364 8/1983 Tojo et al. ..... 418/55
4,457,676 7/1984 Hiraga ..... 418/55

*Primary Examiner*—John J. Vrablik
*Attorney, Agent, or Firm*—Banner, Birch, McKie & Beckett

[57] ABSTRACT

A scroll type compressor is disclosed having a pair of scroll members which interfit with one another at an angular and a radial offset to define at least one pair of sealed-off fluid pockets of which the volume changes due to the relative orbital motion of the scroll members. The base or proximal portion of the inner end of each spiral wrap of the scroll members has an extension which increases the cross-sectional area of the base portion as compared to the upper or distal portion of the inner end. Therefore, the strength and rigidity of the inner end of each wrap, which is exposed to high temperature and high pressure is increased and the endurance of the compressor is significantly improved.

4 Claims, 17 Drawing Figures

SCROLL TYPE COMPRESSOR HAVING REINFORCED SPIRAL ELEMENTS

This application is a continuation of application Ser. No. 540,549, filed Oct. 11, 1983, now abandoned.

BACKGROUND OF THE INVENTION

This invention relates to a fluid displacement apparatus, and more particularly, to a scroll type fluid displacement apparatus of the type which may be used as a compressor, expander or pump.

Scroll type fluid displacement apparatus are well known in the prior art. For example, U.S. Pat. No. 801,182 issued to Creux discloses a scroll type apparatus which includes two scroll members, each having a circular end plate and a spiroidal or involute element. The scroll members are maintained angularly and radially offset so that both spiral elements interfit to form a plurality of line contacts between their spiral curved surfaces to seal off and define, along the axial seals between the end plates and the axial ends of the adjacent spiral elements, at least one pair of fluid pockets. The relative orbital motion of the two scroll members shifts the line contacts along the spiral curved surfaces and, as a result, the volume of the fluid pockets increases or decreases, dependent on the direction of the orbital motion. Thus, a scroll type fluid displacement apparatus may be used to compress, expand or pump fluids.

The principles of operation of a conventional scroll type compressor will now be described with reference to FIGS. 1*a*–1*d*. These figures show the relative movement of the spiral elements used to create the fluid pockets and may be considered as illustrating the end view of a compressor wherein the end plates are removed and only the spiral elements are shown. Spiral elements 1 and 2 are angularly and radially offset and interfit with one another. As shown in FIG. 1*a*, orbiting spiral element 1 and fixed spiral element 2 form four line contacts as shown at points A-D. Fluid pockets 3*a* and 3*b* are partially defined by the walls of spiral elements 1 and 2 at line contacts C-D and A-B, as graphically illustrated by the dotted regions. Fluid pockets 3*a* and 3*b* are further defined by the end plates from which sprial elements 1 and 2 extend. When orbiting spiral element 1 is moved in relation to fixed spiral element 2 so that center O′ of orbiting sprial element 1 revolves around center O of fixed spiral element 2, with a radius of O—O′, fluid pockets 3*a* and 3*b* shift angularly toward the center of the interfitted spiral elements. As a result, the volume of each fluid pocket is gradually reduced as shown in FIGS. 1*b*–1*d*. Therefore, the fluid in each pocket is compressed.

Fluid pockets 3*a* and 3*b* become merged at center portion 4 to form a single pocket while passing from the stage illustrated in FIG. 1*d* to that illustrated in FIG. 1*a*. The volume of the single pocket is reduced by further revolution of orbiting spiral element 1. During the course of revolution, outer spaces which open during the state shown in FIG. 1*b* progressively change as shown in FIGS. 1*c*, 1*d* and 1*a* to form new sealed-off pockets in which additional fluid is newly enclosed and compressed. Accordingly, if circular end plates are disposed and sealed to the axial facing ends of spiral elements 1 and 2, respectively, and if one of the end plates is provided with a discharge port at center portion 4, fluid may be taken into the fluid pockets at the radial outer portion and can be discharged from center portion 4 after compression.

As mentioned above, fluid is compressed in scroll type compressors by changing the volume of the fluid pockets by orbital motion of one of the scroll elements. Fluid pockets are formed by line contacts between the spiral curved surfaces of the spiral elements and axial contacts between the end surface of the circular end plates and the axial end surface of the spiral elements. In accordance with the orbital motion of the orbiting elements, these line contacts shift along the spiral curved surface of the spiral elements to compress the fluid.

The scroll type fluid displacement apparatus is suitable for use as a refrigerant compressor. When used as a compressor, it is desirable that the scroll have sufficient mechanical strength to compress fluids under high pressure. In scrolls known in the prior art, the end plate and associated spiral element are integrally formed. However, the base or end portion of the spiral element, i.e., the portion of the element which joins the end plate, particularly the inner end portion or edge, is disposed in an area of high pressure, temperature and stress which forms at the center of the interfitting elements. Accordingly, the strength and rigidity of the inner end portion of the element is substantially reduced over time due to fatigue and deterioration. As a result, the spiral element is susceptible to developing small cracks in this area. These small cracks soon develop into larger cracks which can lead to the spiral element separating from the end plate and attendant destruction of the scroll.

The scroll type compressor is particularly suitable for use in automobile air conditioners where compact size is desirable. However, if the heights of the spiral elements are increased as a means to enlarge the displacement volume of the compressor without expanding its overall diameter, the stresses developed inside the scroll are increased. Accordingly, the above-described deterioration of the inner portion of each element is hastened.

SUMMARY OF THE INVENTION

It is a primary object of the present invention to provide an improved scroll type fluid displacement apparatus which has a high level of endurance.

It is another object of the present invention to provide an improved scroll type fluid displacement apparatus wherein the strength of the spiral elements is increased without a corresponding increase in the size of the apparatus.

It is another object of the present invention to provide a durable scroll type fluid displacement apparatus wherein the displacement volume of the apparatus is increased without a corresponding increase in the overall diameter of the apparatus.

It is a further object of the present invention to provide a scroll type fluid displacement apparatus which realizes the above-described objectives while at the same time being simple in construction.

A scroll type fluid displacement apparatus according to the present invention includes a housing and a pair of scrolls. One of the scrolls is fixedly disposed relative to the housing and has a circular end plate form which a first spiral wrap extends into the operative interior of the housing. The other scroll is movably disposed for non-rotative orbital movement within the interior of the housing and has a circular end plate from which a second spiral wrap extends. The first and second spiral wraps interfit at an angular and radial offset to form a plurality of line contacts which define at least one pair of sealed-off fluid pockets. A driving and rotation preventing mechanism is operatively connected to the movable scroll to effect its orbital motion, while at the same time preventing its rotation. Thus, the fluid pockets are caused to change in volume due to the orbital motion of the movable scroll. The base or proximal portion of the inner end of each spiral wrap is provided with an extension. The extension thus increases the cross-sectional area of the base or proximal portion of the wrap such that it is larger than the cross-sectional area of the upper or distal portion of the wrap. Therefore, the strength of the base portion of the inner end of the wrap is greatly increased. Thus, destruction of the wrap due to high stress and high temperature is significantly reduced. Accordingly, the volume of the compressor may be increased without corresponding deterioration of the scroll elements.

Further objects, features and aspects of this invention will be understood from the following detailed description of the preferred embodiment of this invention, referring to the annexed drawings.

FIGS. II*a*–II*d* are sectional views which illustrate the relative movement of the interfitting spiral elements showing the extension along the proximal portion of the inner end of each spiral element in accordance with the present invention.

DETAILED DESCRIPTION OF THE PREFERRED EMBODIMENTS

Figure 1A:
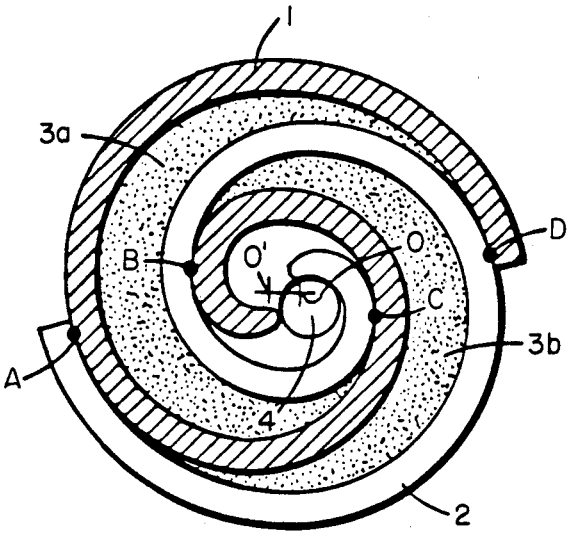
FIGS. 1*a*–1*d* are sectional views which illustrate the relative movement of the interfitting spiral elements which form the fluid compression pockets.
Figure 1B:
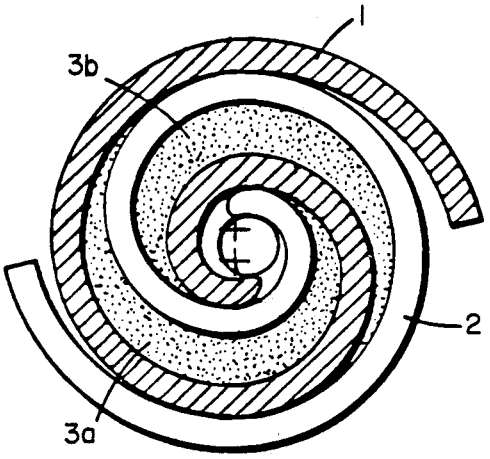
Figure 1C:
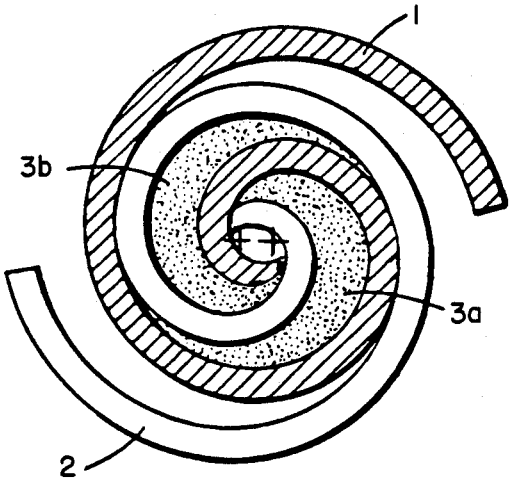
Figure 1D:
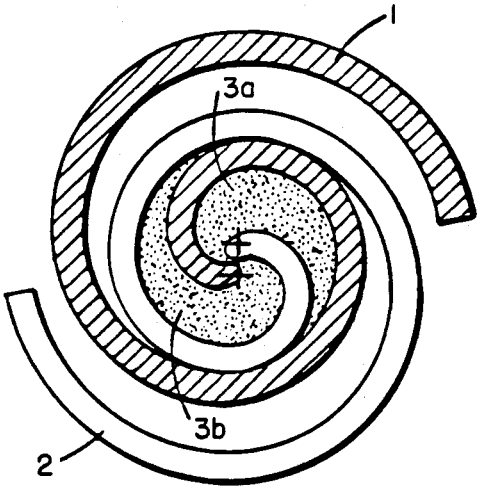
Figure 2:
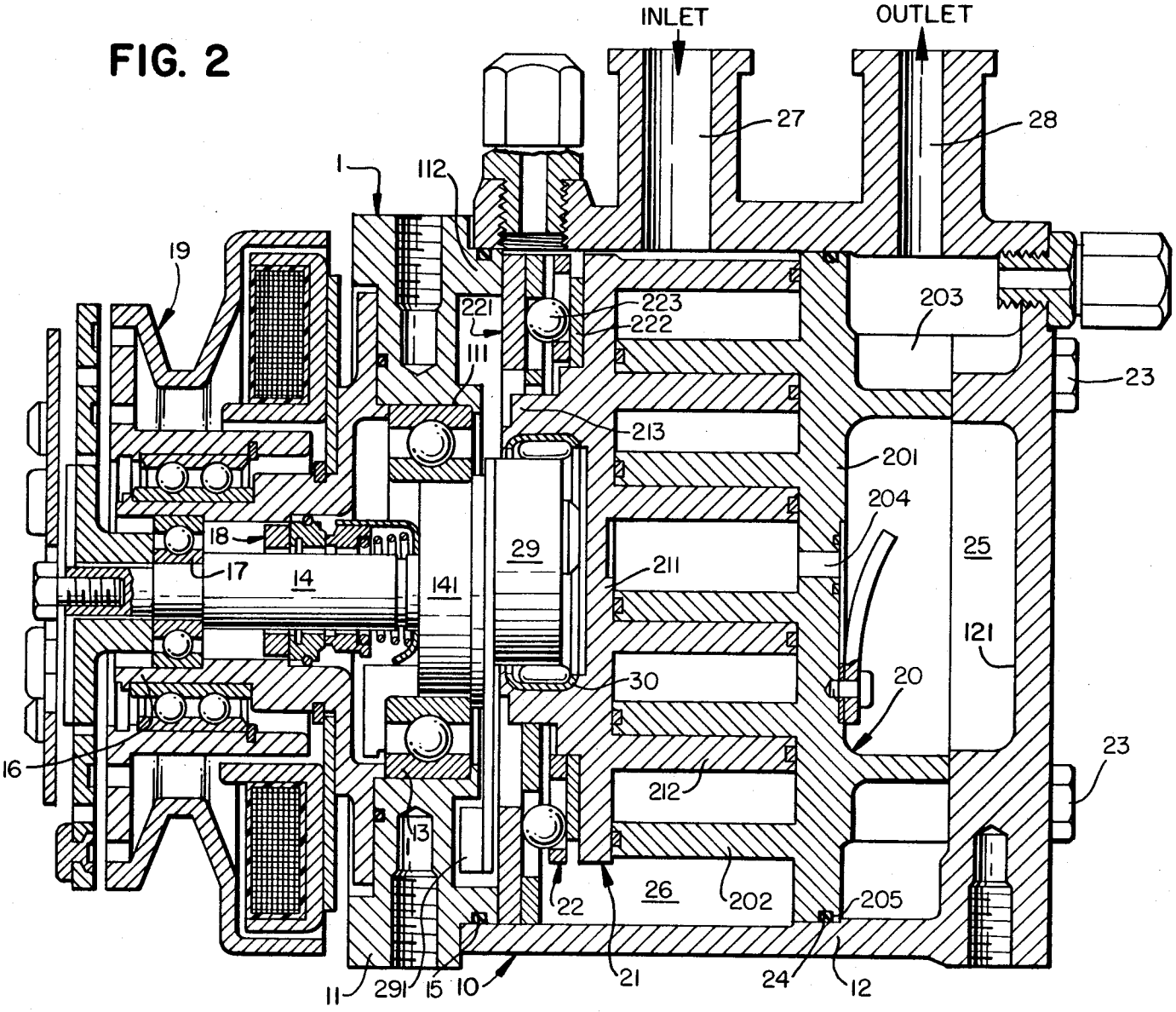
FIG. 2 is a vertical sectional view of a scroll type compressor according to one embodiment of the present invention.

Referring to FIG. 2, a refrigerant compressor unit 1 in accordance with the present invention is shown. The unit includes a compressor housing 10 comprising front end plate 11 and cup-shaped casing 12 which is attached to a side surface of front end plate 11. Opening 111 is formed in the center of front end plate 11 for penetration or passage of drive shaft 14. Annular projection 112, concentric with opening 111, is formed on the inside face of front end plate 11 and projects towards cup-shaped casing 12. An outer peripheral surface of annular projection 112 contacts an inner wall surface of cup-shaped casing 12. O-ring member 15 is placed between front end plate 11 and the open portion of cup-shaped casing 12 to secure a seal between the fitting or mating surface of front end plate 11 and cup-shaped casing 12. Cup-shaped casing 12 is fixed to front end plate 11 by fastening means, for example, bolts and nuts (not shown). The open portion of cup-shaped casing 12 is thereby covered and closed by front end plate 11.

Front end plate 11 has an annular sleeve portion 16 which projects outwardly from the front or outside surface thereof. Sleeve 16 surrounds drive shaft 14 to define a shaft seal cavity. In the embodiment shown in FIG. 2, sleeve 16 is fixed to the front end surface of front end plate 11 by fastening means, such as screws (not shown). Alternatively, sleeve 16 may be integrally formed with front end plate 11.

Drive shaft 14 is rotatably supported by sleeve 16 through bearing 17 which is disposed within the front end portion of sleeve 16. Drive shaft 14 is formed with disk rotor 141 at its inner end portion. Disk rotor 141 is rotatably supported by front end plate 11 through bearing 13 disposed within opening 111. Shaft seal assembly 18 is assembled on drive shaft 14 within the shaft seal cavity of front end plate 11.

Drive shaft 14 is coupled to an electromagnetic clutch 19 which is disposed on the outer portion of sleeve 16. Drive shaft 14 is driven by an external drive power source (e.g., the motor of a vehicle) through electromagnetic clutch 19.

Fixed scroll 20, orbiting scroll 21, the drive mechanism for orbiting scroll 21 and a rotation-preventing/-thrust bearing device 22 for orbiting scroll 21, are disposed in the inner chamber of cup-shaped casing 12. The inner chamber is formed between the inner wall of cup-shaped casing 12 and front end plate 11.

Fixed scroll 20 includes circular end plate 201 and wrap or involute spiral element 202 affixed to and extending from a side surface of circular end plate 201. Circular end plate 201 is formed with a plurality of legs 203 axially projecting from its other major side surface. An axial end surface of each leg 203 is fitted against the inner surface of a bottom plate portion 121 of cut-shaped casing 12 and fixed by screws 23 which screw into legs 203 from the outside of bottom plate portion 121. Groove 205 is formed on the outer peripheral surface of circular end plate 201 and seal ring member 24 is disposed therein to form a seal between the inner surface of cup-shaped casing 12 and the outer peripheral surface of circular end plate 201. Thus, the inner chamber of cup-shaped casing 12 is partitioned into two chambers by circular end plate 201, i.e., a rear or discharge chamber 25 in which legs 203 are disposed and a front or suction chamber 26 in which spiral element 202 of fixed scroll 20 is disposed.

Cup-shaped casing 12 is provided with fluid inlet port 27 and fluid outlet port 28, which are connected to rear and front chambers 26 and 25, respectively. A hole or discharge port 204 is formed through circular end plate 201 at a position near the center of spiral element 202. A reed valve 206 closes discharge port 204.

Orbiting scroll 21 is disposed in front chamber 26. Orbiting scroll 21 also comprises circular end plate 211 and wrap or involute spiral element 212 affixed to and extending from a side surface of circular end plate 211. Spiral element 212 and spiral element 202 interfit at an angular offset of 180° and at a predetermined radial offset. A pair of fluid pockets are thereby defined between spiral elements 202, 212. Discharge port 204 connects the fluid pockets to rear chamber 25. Orbiting scroll 21 is connected via drive shaft 14 to a drive mechanism (not shown) and to rotation-preventing/thrust bearing device 22. The driving mechanism and rotation-preventing/thrust bearing device 22 effect orbital motion of orbiting scroll 21 by rotation of drive shaft 14 to thereby compress fluid passing through the compressor unit as described above.

A crank pin or drive pin (not shown) projects axially inwardly from an end surface of disk rotor 141 and is radially offset from the center of drive shaft 14. Circular end plate 211 of orbiting scroll 21 is provided with a tubular boss 213 projecting axially outwardly from the end surface opposite to the side from which spiral elements 212 extends. Axial bushing 29 is fitted into boss 213, and is rotatably supported therein by a bearing, such as needle bearing 30. Bushing 29 has a balance weight 291 which is shaped in the form of a disk or ring and extends radially from bushing 29 along a front surface thereof. An eccentric hole (not shown) is formed in bushing 29 radially offset from the center of bushing 29. The above-described drive pin is fitted into the eccentrically disposed hole. Bushing 29 is therefore driven by the rotation of the drive pin and is permitted to rotate due to needle bearing 30, compliantly driving orbiting scroll 21 so that it follows the contour of fixed scroll 20 regardless of manufacturing variances from the ideal spiral shape. The spiral element of orbiting scroll 21 is thus pushed against the spiral element of fixed scroll 20 to secure the line contacts and effect radial sealing due to the force created between the driving point and the reaction force of the pressurized gas.

Rotation-preventing/thrust bearing device 22 is disposed around boss 213 and is comprised of fixed ring 221 fastened against the inner end surface of front end plate 11, orbiting ring 222 fastened against the end surface of circular end plate 211 and a plurality of ball elements 223 which are retained in a pair of opposing holes formed through rings 221, 222. Rotation of orbiting scroll 21 is thus prevented by the interaction of balls 223 with rings 221, 222. The axial thrust load from orbiting scroll 21 is supported on front end plate 11 through balls 223 and fixed ring 221.

Figure 3:
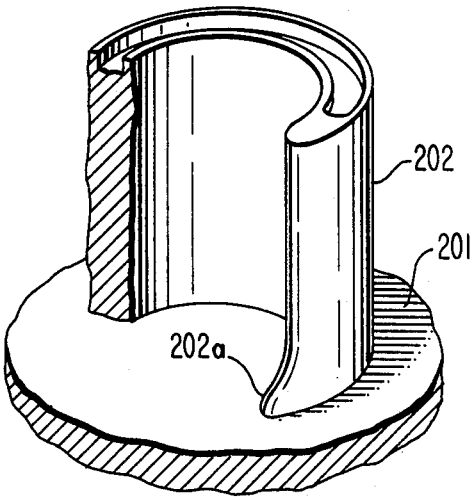
FIGS. 3–9 are perspective views of a scroll element in accordance with various embodiments of the present invention.
Figure 4:
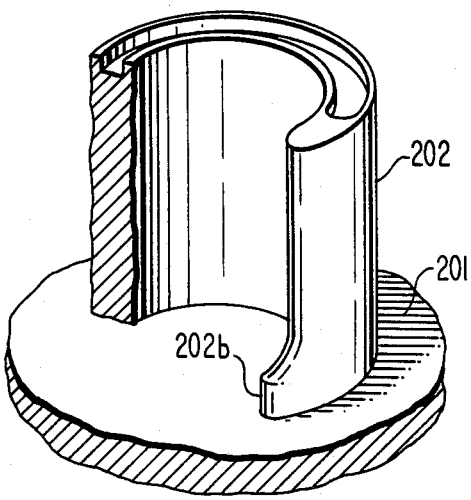

With reference to FIG. 3, the configuration of spiral element 202 is shown in accordance with one embodiment of the present invention. As shown in FIG. 3, the base or proximal portion of the inner end of spiral element 202 has a beveled portion 202*a* which extends along the involute curve of the element. The proximal portion of the spiral element is the portion of the element in the vicinity of the end plate. Beveled portion 202*a* can be formed simultaneously with the casting of scroll 20. FIG. 4 illustrates another embodiment of the inner end of spiral element 202. In this embodiment, the inner end of spiral element 202 is formed with an extended portion 202*b*.

In accordance with the above-described embodiments of the scroll, the cross-sectional area along the proximal portion of the base of the inner end along spiral element is made larger than the cross-sectional area of the upper or distal portion of the spiral element without a corresponding increase in the area of the scroll which is exposed to high fluid temperatures and stresses. The distal portion of the spiral element is the portion of the element away from the proximal portion. Therefore, the concentration of stress along the base or proximal portion of the spiral element is substantially reduced. Thus, the occurrence of cracks at the base of the inner end of the spiral element is greatly reduced, without an increase in the overall size of the compressor.

Figure 5:
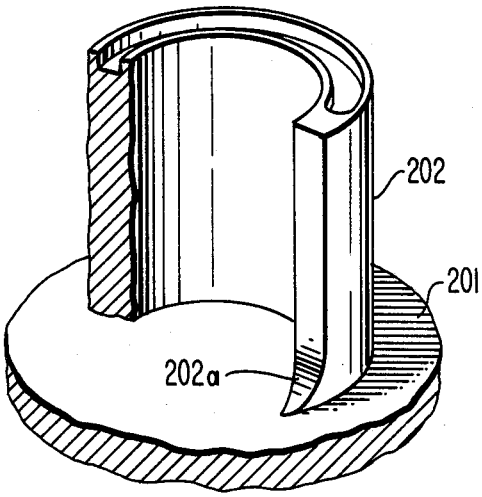
Figure 6:
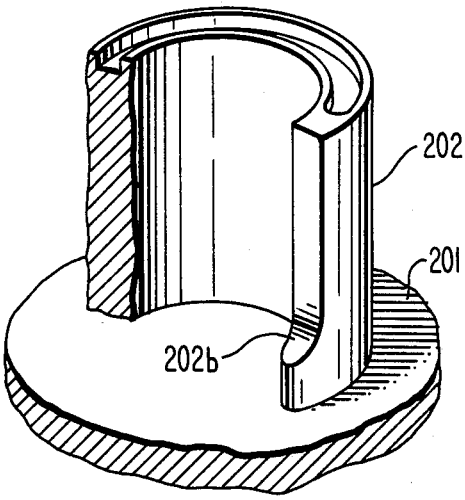

Referring to FIGS. 5 and 6, other embodiments of the present invention are shown. In the embodiment shown in FIG. 5 the inner end portion of spiral element 202 is fabricated by an end mill to form beveled portion 202*a*. In the embodiment shown in FIG. 6, an end mill is used to form extended portion 202*b*. In the embodiment shown in FIG. 6, the inner end of the spiral element is formed by casting of the scroll to provide a cutting area for the end mill to finish the spiral element.

Figure 7:
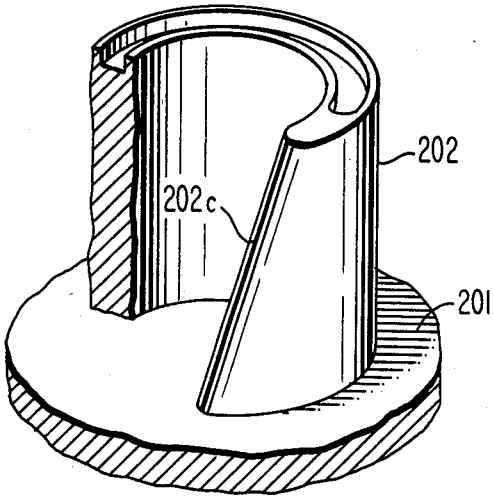
Figure 8:
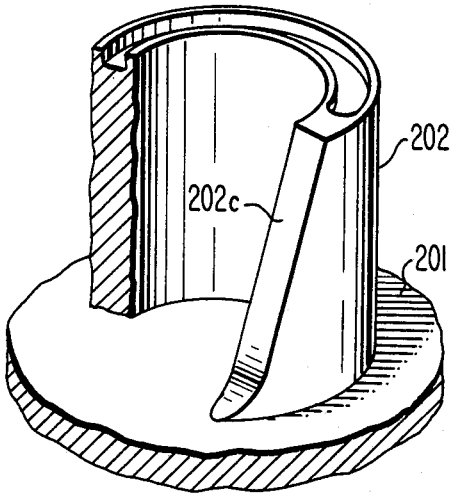

Referring to FIGS. 7 and 8, further embodiments of the present invention are shown. In these embodiments, the inner end of spiral element 202 is provided with an inclined portion 202*c* which extends toward the base or proximal portion of the spiral element. FIG. 7 shows an embodiment of the scroll which is manufactured by casting. FIG. 8 shows another embodiment which is finished by an end mill.

Figure 9:
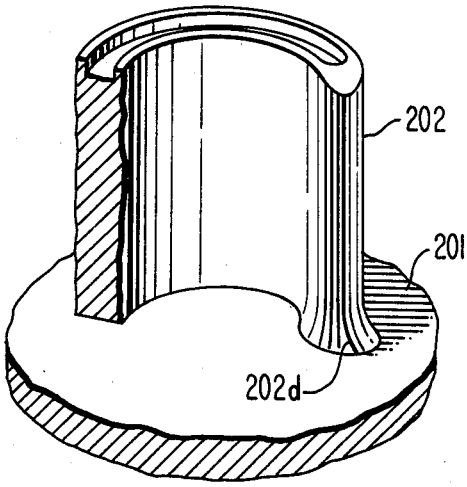
Figure 10:
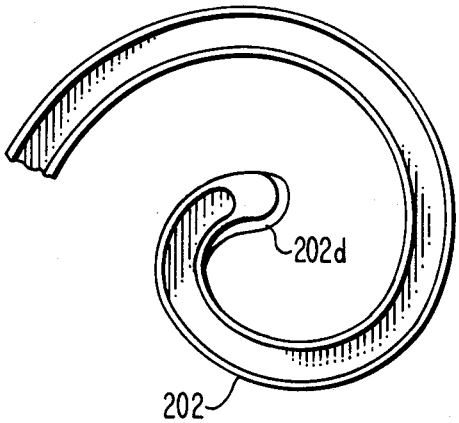
FIG. 10 is an end view of the scroll element shown in FIG. 9.

With reference to FIGS. 9 and 10, a further embodiment of the present invention is shown. In this embodiment, bevel 202*d* is formed at the base or proximal portion of the inner wall of the inner end of spiral element 202, as shown in FIG. 10. Beveled portion 202*d* can be formed by casting simultaneously with forming of the scroll or may be formed by an end mill as a subsequent operation.

Figure 11A:
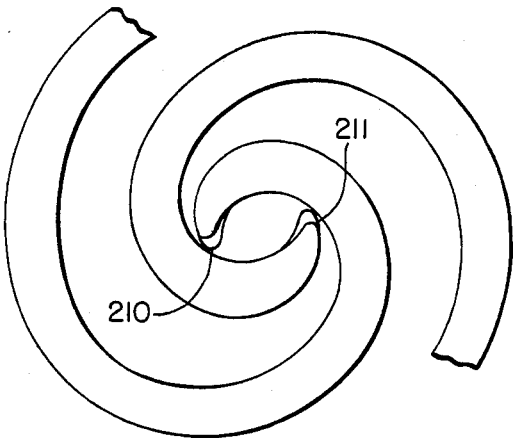
Figure 11B:
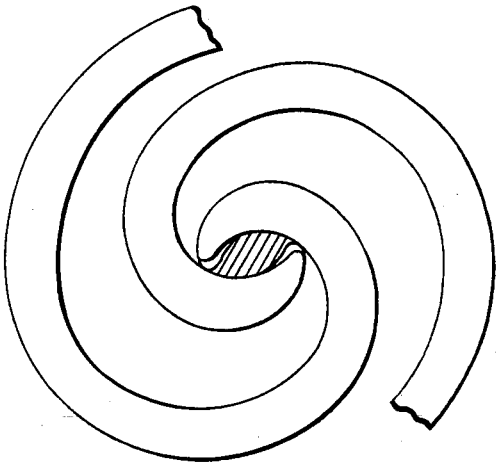
Figure 11C:
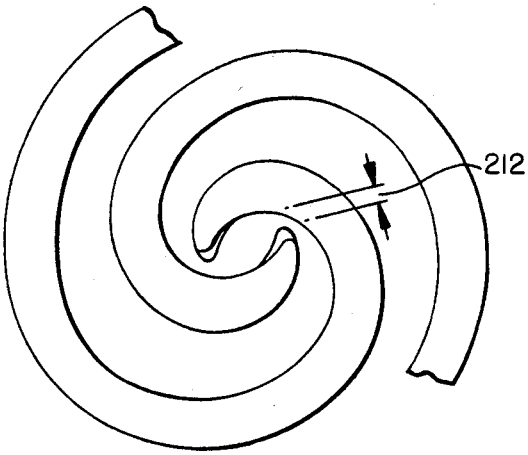

FIGS. 11*a*–11*d* illustrate the relative movement of the interfitting spiral elements with extensions 210 and 211 in accordance with the present invention. As shown in FIG. 11*a*, the outer wall surface of each element is in contact with the inner wall surface of the facing element thus maintaining a sealed off fluid pocket.

Figure 11D:
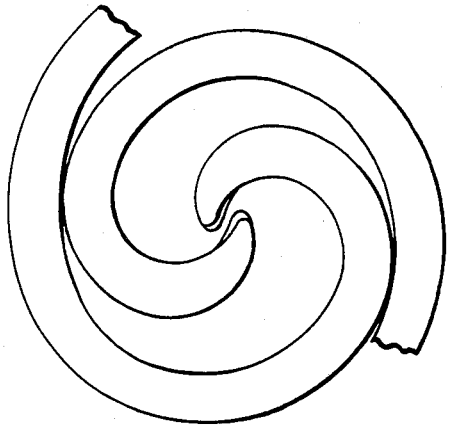

As the operation of the interfitting spiral elements moves from the position shown in FIG. 11*a* to the position shown in FIG. 11*d*, the innermost end portions of the elements with extensions 210 and 211 are separated from one another by small gap 212. Thus, interference between extension portions 210 and 211 is prevented. The volume of the fluid pocket is very small at this stage in the operation. Thus, there is only a small amount of leakage from the fluid pocket which applicant has found not to create a problem.

This invention has been described in detail in connection with several preferred embodiments. These embodiments are merely for example only and this invention is not restricted thereto. It will be easily understood by those skilled in the art that other variations and modifications can be easily made within the scope of this invention, which is defined by the appended claims.

I claim:

1. In a scroll type fluid displacement apparatus having a housing, first and second scrolls within said housing, said first scroll being fixedly disposed relative to said housing and having an end plate from which a first spiral wrap extends into the interior of said housing, said second scroll being movably disposed for non-rotative orbital movement within the interior of said housing and having an end plate from which a second spiral wrap extends, said first and second wraps having a rectangular shaped cross-section and interfitting at an angular and radial offset to form a plurality of line contacts and axial contacts to define at least one pair of sealed off fluid pockets, and a driving and rotation preventing mechanism operatively connected to said second scroll to effect the orbital motion of said second scroll while preventing rotation thereof, thus causing said at least one pair of fluid pockets to change in volume due to the orbital motion of said second scroll, an improvement wherein the proximal portion of the inner terminal end of each of said spiral wraps is provided with an extension such that the cross-sectional area of said spiral wraps along said proximal portion is larger than the cross-sectional area along the distal portion of said inner end, wherein the strength and rigidity of said first and second wraps are increased.

2. The scroll type fluid displacement apparatus of claim 1 wherein said extension is a beveled extension.

3. The scroll type fluid displacement apparatus of claim 2, wherein said beveled extension is an extension of the involute curves of the spiral wrap.

4. The scroll type fluid displacement apparatus of claim 1 wherein said extension has an inclined leading edge extending from said distal portion to the end plate of the spiral wrap.

* * * * *